United States Patent [19]

Christe

[11] 4,207,124

[45] Jun. 10, 1980

[54] HIGH DETONATION PRESSURE EXPLOSIVES

[75] Inventor: Karl O. Christe, Calabasas, Calif.

[73] Assignee: The United States of America as represented by the Secretary of the Navy, Washington, D.C.

[21] Appl. No.: 902,642

[22] Filed: May 4, 1978

[51] Int. Cl.[2] ..... C06B 25/34

[52] U.S. Cl. ..... 149/92; 149/88; 149/119

[58] Field of Search ..... 149/92, 119, 19.1, 19.9, 149/88

[56] References Cited

U.S. PATENT DOCUMENTS

| | | | |
|---|---|---|---|
| 3,213,610 | 10/1965 | Grigger et al. | 60/35.4 |
| 3,245,849 | 4/1966 | Klager | 149/19.4 |
| 3,325,318 | 6/1967 | Pauliukonis | 149/109 |
| 3,449,179 | 6/1969 | Minekawa et al. | 149/92 |
| 3,503,719 | 3/1970 | Christe et al. | 23/315 |
| 3,520,742 | 7/1970 | Witz | 149/19.9 |
| 3,709,748 | 1/1973 | Roberto | 149/109 |
| 3,723,202 | 3/1973 | Butler et al. | 149/92 |
| 3,741,832 | 6/1973 | Spenadel et al. | 149/109 |
| 3,751,312 | 8/1973 | Wright et al. | 149/109 |
| 3,752,703 | 8/1973 | Toy et al. | 149/19 |
| 3,839,106 | 10/1974 | De Prisque et al. | 149/92 |
| 3,963,542 | 6/1976 | Pilipovich | 149/19.3 |
| 3,980,509 | 9/1976 | Lubowitz | 149/19.3 |
| 3,981,756 | 9/1976 | Gotzmer | 149/19.3 |
| 4,001,136 | 1/1977 | Channell et al. | 252/187 |
| 4,003,771 | 1/1977 | Lubowitz | 149/17 |

OTHER PUBLICATIONS

Christe et al (I), *Inorganic Chemistry,* 12 (#10) 2478–2481 (1973).
Christe, *Inorganic Chemistry,* 16, 2238 (1977).
Christe et al II, *Inorganic Chemistry,* 16, 849 (1977).
Christe et al III, *Inorganic Chemistry,* 16, 937 (1977).
Christe et al IV, *Inorganic Chemistry,* 15, 1275 (1976).
Christe et al V, *Inorganic Chemistry,* 16, 353 (1977).
Christe et al VI, *J. of Fluorine Chemistry,* 8, 541 (1976).
Christe et al VII, *J. of Fluorine Chemistry,* 11, 71 (1978).
Schack et al, *J. Inorg. Nucl. Chem.,* Supplement (1976).

*Primary Examiner*—Edward A. Miller
*Attorney, Agent, or Firm*—R. S. Sciascia; W. Thom Skeer; Lloyd E. K. Pohl

[57] ABSTRACT

Insensitive, high performance explosives obtained by combining certain energetic, high density inorganic compounds with insensitive, underoxidized organic nitro compounds.

7 Claims, No Drawings

HIGH DETONATION PRESSURE EXPLOSIVES

BACKGROUND OF THE INVENTION

1. Field of the Invention.

This invention relates to insensitive, high performance explosives.

2. Description of the Prior Art.

The use of organic nitro compounds as explosives is well known. These compounds are self-oxidizing, i.e., the nitro groups provide the oxygen used in oxidation.

The highest detonation pressures achievable with the currently used organic nitro compounds are about 390 kbar. Further, the best performers (those from which detonation pressures approaching 390 Kbar are achievable) are highly sensitive. Thus, the use of the highest performing organic nitro compounds as explosives is risky and impractical. On the other hand, the lower performing explosives which possess acceptable stability are, without exception, underoxidized and generally exhibit low densities. The densities of the stable explosives are generally less than two grams per $cm^3$. These two factors, i.e., the underoxidized nature of the stable organic nitro compounds and their low densities, severely limit their performance.

SUMMARY OF THE INVENTION

It has now been found that the performance of explosives based on commonly used organic nitro compounds can be increased to about 530 kbar by adding certain dense and stable but highly energetic inorganic oxidizers. Among the suitable oxidizers are: $(NF_4)_2TiF_6$, $NF_4BF_4$, $Ti(ClO_4)_4$, $(NF_4)_2NiF_6$ and other hereinafter named compounds.

DESCRIPTION OF THE PREFERRED EMBODIMENTS

Typical examples of performance increases achievable by the use of the inorganic oxidizers of this invention are illustrated in the following table.

TABLE

Examples of Theoretical Performance Improvements

| System | Weight % | Detonation Pressure (kb) |
|---|---|---|
| Nitroquanidine (NQ) | 100 | 255 |
| NQ + $(NF_4)_2$ $TiF_6$ | 43–57 | 349 |
| Triaminotrinitrobenzene (TATB) | 100 | 280 |
| TATB + $NF_4$ $BF_4$ | 29–71 | 375 |
| TATB + $(NF_4)_2$ $TiF_6$ | 30–70 | 408 |
| HMX | 100 | 382 |
| HMX + $NF_4$ $BF_4$ | 51–49 | 449 |
| HMX + Ti $(C10_4)_4$ | 70–30 | 456 |
| HMX + $(NF_4)_2$ $TiF_6$ | 52–48 | 471 |
| HMX + $(NF_4)_2$ $NiF_6$ | 56–44 | 527 |

The detonation pressures set forth in the foregoing table were calculated by means of the Kamlet correlation (*J. Chem. Phys.*, 48, 23 (1968)), a method commonly used for the performance evaluation of explosives. The percentage of oxidizer used was chosen to obtain complete combustion of the organic nitro compound (to $CO_2$, $N_2$ and HF in the case of HMX or NQ and to $COF_2$, $N_2$ and HF in the case of TATB). As can be seen from the table, the performance of organic nitro explosives is significantly increased by the addition of dense energetic inorgaic oxidizers.

Laboratory tests have shown that the oxidizers and explosives are mutually compatible. For example, HMX and $NF_4BF_4$ were found to be stable at 150° C. and drop weight tests of the HMX/$NF_4BF_4$ mixtures showed only a moderate increase in sensitivity over that of pure HMX.

The examples given in the above table are illustrative only and are not intended to limit the scope of the invention. Other commonly used, underoxidized organic nitro compounds of suitable stability could be substituted for the explosives given as examples in the table. Similarly, other inorganic oxidizers could be substituted for those listed in the table.

The primary requirements for suitable oxidizers are high energy content, high density, high thermal stability and low reactivity with the organic nitro compounds. From this point of view, $NF_4+$ containing salts are ideally suited. The $NF_4+$cation is isoelectronic with the extremely inert $CF_4$ molecule and, therefore, in spite of its high energy content, a relatively high activation energy is required to cause it to react with other compounds.

The concept of this invention is not limited to fluorine containing oxidizers. As can be seen from the example of $Ti(ClO_4)_4$ in the table, this fluorine-free oxidizer is equally useful. By analogy with the $NF_4+$ salts, $Ti(ClO_4)_4$ possesses all the necessary properties for use as an explosive ingredient.

Although oxygen containing oxidizers will be as effective as fluorine containing oxidizers in most explosives, fluorine containing oxidizers are advantageous in aluminized formulations. The addition of aluminum is known to increase the performance of an explosive, but the $Al_2O_3$ combustion product formed in a fluorine-free system may not remain for a long enough time in the gas phase. $AlF_3$, on the other hand, is formed as a combustion product when fluorine containing oxidizers are used. Since $AlF_3$ (sublimation point 1270° C.) is much more volatile than $Al_2O_3$ (boiling point 2250° C.), the use of fluorine containing oxidizers offers a distinct advantage for aluminized systems in that efficiencies higher than those obtainable with oxygen containing oxidizers are achieved.

It has been stated above that the oxidizers listed in the table are illustrative only. Examples of other suitable oxidizers are $NF_4+$ salts such as: $NF_4Sb_3F_{16}$, $NF_4SbF_6$, $NF_4HF_2$, $NF_4BiF_6$, $NF_4PF_6$, $NF_4GeF_5$, $NF_4AsF_6$, $NF_4Ti_2F_9$, $NF_4Ti_3F_{13}$, $NF_4Ti_6F_{25}$, $(NF_4)_2SnF_6$ and $NF_4SnF_5$ and other metal perchlorates.

The salts disclosed herein are not soluble in organic nitro compounds so their use in liquid explosives in conjunction with liquid organic compounds is not possible. However, they may be used in plastic bonded (solid) explosives of the type wherein explosive ingredients are bound in a suitable binder (many of which are known in the art) and in slurries where oxidizer particles are suspended in liquid organic nitro compounds.

What is claimed is:

1. An explosive composition comprising an explosive organic nitro compound, and enough of a dense inorganic oxidizer having an $NF_4+$ ion in conjunction with said organic nitro compound to improve detonation pressure.

2. An explosive composition according to claim 1 wherein said $NF_4+$ containing oxidizer is selected from the group consisting of $(NF_4)_2TiF_6$, $NF_4BF_4$, $(NF_4)_2NiF_6$, $NF_4Sb_3F_{16}$, $NF_4SbF_6$, $NF_4HF_2$, $NF_4BiF_6$, $NF_4PF_6$, $NF_4GeF_5$, $NF_4AsF_6$, $NF_4Ti_2F_9$, $NF_4Ti_3F_{13}$, $NF_4Ti_6F_{25}$, $(NF_4)_2SnF_6$ and $NF_4SnF_5$.

3. An explosive composition according to claim 1 which is a slurried explosive wherein particles of said dense inorganic oxidizer are suspended in a liquid organic nitro compound.

4. An explosive composition according to claim 1 wherein said organic nitro compound is selected from the group consisting of triaminotrinitrobenzene, nitroguanidine and cyclotetramethylenetetranitramine.

5. An explosive composition according to claim 4 wherein said organic nitro compound is nitroguanidine and said dense inorganic oxidizer is $(NF_4)_2TiF_6$.

6. An explosive composition according to claim 1 wherein said organic nitro compound is triaminotrinitrobenzene and said dense inorganic oxidizer is selected from the group consisting of $NF_4BF_4$ and $(NF_4)_2TiF_6$.

7. An explosive composition according to claim 1 wherein said organic nitro compound is HMX and said dense inorganic oxidizer is selected from the group consisting of $NF_4BF_4$, $(NF_4)_2TiF_6$ and $(NF_4)_2NiF_6$.

* * * * *